US006431678B2

(12) United States Patent
Beck et al.

(10) Patent No.: US 6,431,678 B2
(45) **Date of Patent: *Aug. 13, 2002**

(54) INK LEAKAGE DETECTING APPARATUS

(75) Inventors: Jeffery S. Beck, Corvalis, OR (US); James A. Feinn, San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,066

(22) Filed: Sep. 1, 1998

(51) Int. Cl.[7] ..... B41J 29/393
(52) U.S. Cl. ..... 347/19
(58) Field of Search ..... 347/19, 23, 20, 347/7

(56) References Cited

U.S. PATENT DOCUMENTS 5,430,381 A * 7/1995 Dower ..... 324/452
5,442,386 A 8/1995 Childers et al. ..... 347/50
5,446,484 A * 8/1995 Hoisington et al. ..... 347/68
5,538,586 A 7/1996 Swanson et al. ..... 156/307.6
5,610,635 A * 3/1997 Murray et al. ..... 347/19
5,760,797 A * 6/1998 Koizumi et al. ..... 347/19
6,039,428 A * 3/2000 Juve ..... 347/19
6,109,734 A * 8/2000 Kashino et al. ..... 347/65

FOREIGN PATENT DOCUMENTS

JP 62128101 A * 6/1987
JP 07060954 A * 3/1995 ..... B41J/2/01
JP 10086357 A * 4/1998 ..... B41J/2/01

OTHER PUBLICATIONS

Millman, Jacob and Grabel, Arvin. Microelectronics, Second Edition. N.Y., McGraw–Hill Book Company, 1987. p. 156–157. TK7874.M527.*

Thermagon, Inc. News Release [online], [retrieved on Nov. 28, 2000]. Retrieved from the Internet <URL: http://www.thermagon.com/news.htm>.*

Millman, Jacob and Grabel, Arvin. Microelectronics, Second Edition. N.Y., McGraw–Hill Book Company, 1987. p. 133. TK7874.M527.*

* cited by examiner

*Primary Examiner*—John Barlow
*Assistant Examiner*—Julian D. Huffman

(57) ABSTRACT

An apparatus and method for detecting ink leakage in a print head. Conductive material is provided on a print head substrate that functions as a detector for ink that has leaked out of the established ink well or conduit. The detector conductive material is preferably arranged in proximity to power and/or control signal conductors and senses when leaked ink is threatening these conductors.

3 Claims, 1 Drawing Sheet

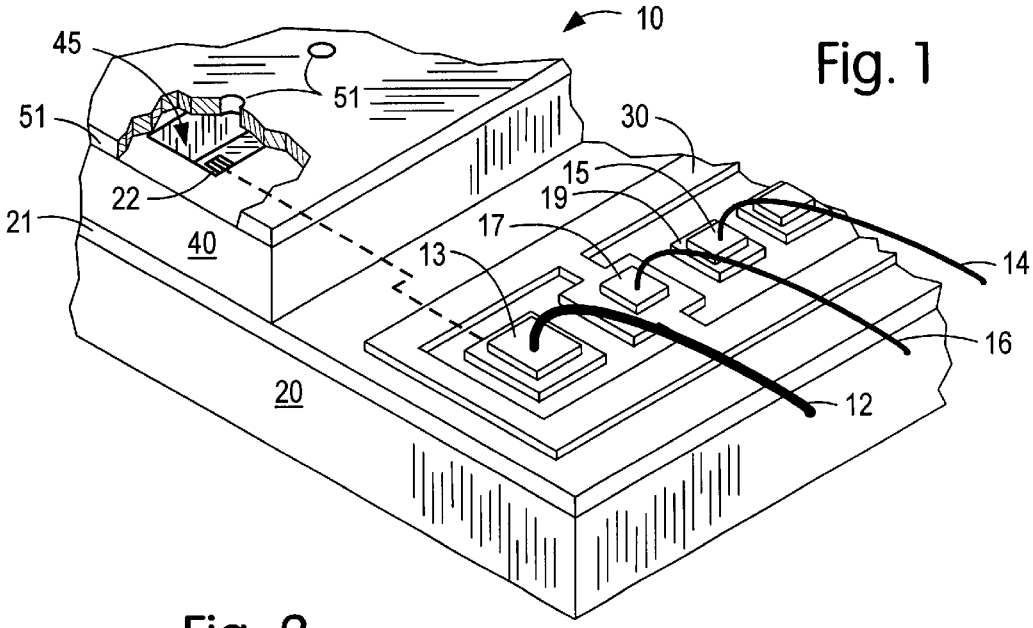
Fig. 1
Fig. 2
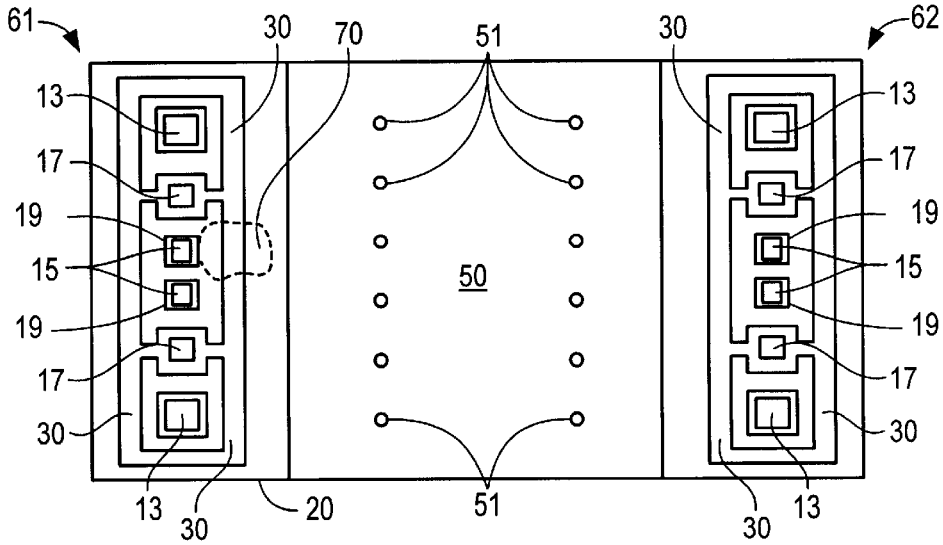
Fig. 3
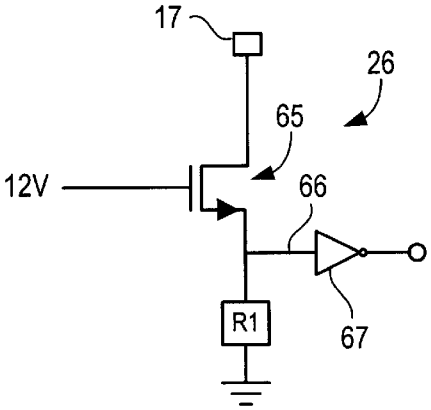
Fig. 4
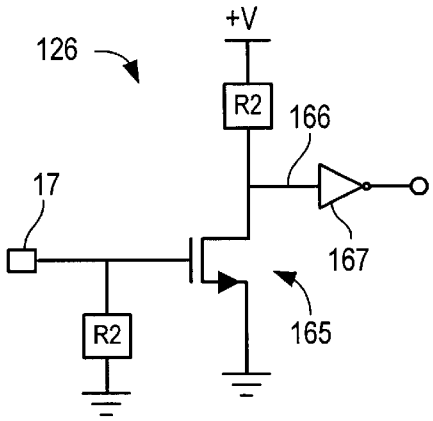

INK LEAKAGE DETECTING APPARATUS

FIELD OF THE INVENTION

The present invention relates to inkjet printers and, more specifically, to the detection of ink leakage in a print head of such a printer.

BACKGROUND OF THE INVENTION

Inkjet and like printers and cartridges are known in the art and include those made by Hewlett-Packard, Canon and Epson, amongst others. Inkjet printers include an ink supply and a print head to which ink is delivered for controlled discharge. Typically, an inkjet print head includes a substrate on or in which an expulsion mechanism is formed, a barrier plate that provides channels for delivering ink to the expulsion mechanism and an orifice plate positioned over the barrier layer such that ink is expelled through openings in the orifice plate. Power supply lines and signal processing or control lines are coupled to componentry in or on the substrate.

A disadvantage of known inkjet print head arrangements, however, is that the ink used therein is generally invasive and with time will leak outside of its confined area. For example, ink may leak in between the substrate and barrier layer or between the barrier layer and orifice plate, amongst other leakage channels. The escaped ink may seep onto the interconnect region(s) of the substrate where it can cause a short between the power and control lines or otherwise cause a malfunction of the print head.

Hence, a need exists for detecting when ink in an inkjet print head has escaped its confined area and may cause a malfunction of the print head. Furthermore, a need exists for a print head ink leakage detector that can be implemented in an economical, non-overly complex manner.

SUMMARY OF THE INVENTION

Accordingly, it is an object of the present invention to provide an inkjet print head that includes a mechanism that detects when ink has escaped its confined space.

It is another object of the present invention to provide such a print head that (1) can be economically implemented and (2) can uniquely identify itself when it has failed.

It is another object of the present invention to provide such a print head that utilizes conductive material adjacent the power and/or control lines to detect undesired leakage.

It is also an object of the present invention to provide an inkjet printer that incorporates such a print head.

These and related objects of the present invention are achieved by use of a ink leakage detecting apparatus as described herein.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIG. 1 is a partial cutaway isometric view of an inkjet printhead in accordance with the present invention.

FIG. 2 is a top view of an inkjet print head in accordance with the present invention.

FIG. 3 is a schematic diagram of a detection circuit in accordance with the present invention.

FIG. 4 is an alternative embodiment of a detection circuit in accordance with the present invention.

DETAILED DESCRIPTION

Referring to FIG. 1, a partial isometric view of an inkjet print head 10 in accordance with the present invention is shown. Print head 10 includes a substrate 20 to which a power line 12, a control line 14 and a detect line 16 are coupled.

Substrate 20 includes an ink expulsion device 22 formed therein or thereon that they may be thermally, mechanically or otherwise actuated. In a preferred embodiment, the expulsion device is thermally (resistively) actuated as is known. Substrate 20 is preferably made of a semiconductive material such as silicon, Si, and includes a detection circuit 26 (not shown in FIG. 1; discussed in more detail below with respect to FIG. 3) and may optionally include a control circuit (i.e., on-chip as opposed to off-chip control logic; not shown in FIG. 1).

A passivation layer 21, for example of Si02, preferably forms the top layer of the substrate. A plurality of other layers are formed in substrate 20 that permit operation of the thermal ink expulsion device and electrical connection to detection circuit 26. These layers and the photolithographic steps or the like used to form them are known in the art and for clarity of the drawing these layers are not shown in FIG. 1.

Power line 12, control line 14 and detect line 16 are coupled to contact pads 13, 15 and 17, respectively, which are typically formed of gold or a like conductive material. An interface conductive layer 19 as is known is provided to couple the contact pads to the passivation layer. Tantalum, Ta, or the like is a suitable interface conductive material. Power line 12, control line 14 and detect line 16 are coupled to expulsion device 22, control circuitry (not shown) and detection circuit 26 respectively. The power line connection is shown as a phantom line.

A barrier layer 40 is provided on substrate 20 and an orifice plate 50 having an orifice or nozzle 51 is provided over barrier layer 40. Amongst other implementation, the orifice plate may be formed of kapton or a like material that is lazer abladed to form the nozzle orifices. The substrate, barrier layer and orifice plate combine to form an ink conduit or well 45 that directs ink over the expulsion mechanism. An ink supply (not shown) is coupled to ink conduit 45.

As mentioned above in the Background of the Invention section, the ink used in conventional inkjet printers is invasive and with time (i.e., towards the end of life of the print head) will begin to seep between the orifice plate and barrier layer or between the barrier layer and substrate or through cracks in the passivation layer or through other channels. If this ink is permitted to flow across the substrate such that it electrically interconnects the power line and the control line, then the print head will malfunction.

In an effort to prevent this situation, the present invention provides detectors 30 adjacent to the power and control lines (an arrangement of detector 30 is better shown in FIG. 2). The detectors are coupled to detect line 16 and detection circuit 26 and when ink electrically interconnects the power or control line to a detector, a voltage is provided to detection circuit 26 which in turn generates an ink leakage signal (as discussed in more detail in reference to FIGS. 3 and 4). The generated signal uniquely identifies the print head that is failing and may be used to prompt a user to replace that print head. Unique identification, for example in a color printer having cyan, magenta, yellow and black color print heads, permits a user to replace only the failing print head.

Detectors 30 are formed of a conductive material and may be formed of the same conductive interface material 19 used to couple the power, control and detect contact pads to the substrate. The detectors 30 and material 19 may be put down in the same fabrication step. While not shown from the perspective of FIG. 1, detector 30 is coupled to layer conductive material or 19 under the detect contact pad.

Referring to FIG. 2, a top view of an inkjet print head in accordance with the present invention is shown. The layout of the print head of FIG. 2 is intended to illustrate a representative print head. It will be understood by those skilled in the art that inkjet layouts including such aspects as where conductors are connected, where the orifice plate is positioned, and how the orifices 51 are oriented may vary depending on a particular design. It should further be understood that the present invention is applicable to all print head arrangements and is in no way limited to the pedagogic embodiments disclosed in FIGS. 1–2.

FIG. 2 illustrates orifice plate 50 situated over substrate 20. Connection regions (61,62) are respectively provided to the left and right of the orifice plate 50 and each connection region includes power contact pads 13, control contact pads 15 and detect contact pads 17. Contact pads 13 and 15 are coupled to substrate 20 by conductive interface material 19. Contact pads 17 are coupled to the substrate by similar conductive material 19, however, this material is formed integrally with the material that forms detectors 30. These detectors or the "detector arrangement" is preferably formed about the power and control contact pads such that the leakage of ink onto both a detector and the power or control lines (as shown by phantom ink blot 70) causes a voltage to be propagated through the conductive ink to the detector. The detector is in turned coupled to the detection circuit which outputs an ink leakage signal upon receipt of a voltage from a power or control line or other source. While one arrangement of detectors is shown in FIG. 2 it should be noted that other arrangements could also be utilized.

Referring to FIG. 3, a schematic diagram of detection circuit 26 in accordance with the present invention is shown. Detection 26 preferably includes a MOSFET transistor 65 that receives a forward biased gate voltage (preferably 12V). The detect contact pad(s) 17 is/are preferably coupled to the drain MOSFET 65 and the source is preferably coupled through a resistor, R1, to ground. The detection circuit output 66 is preferably coupled at the source and buffered by an inverting buffer 67.

Referring to FIG. 4, an alternative embodiment of a detection circuit (labeled 126) is shown. Detection circuit 126 preferably includes a MOSFET transistor 165 that has a gate which is coupled to detect contact pad(s) 17 through a resistor, R3, to ground. The drain is pulled through a resistor, R2, to the power supply voltage and the source is tied to ground. The output 166 is coupled to the drain and preferably buffered by inverting buffer 167. While circuits 26 and 126 provide the same function, the circuit of FIG. 3 eliminates the input load caused by R3.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A print head apparatus, comprising:

a substrate;

an ink expulsion mechanism coupled to said substrate;

a conduit for channeling ink to said expulsion mechanism;

a mechanism that detects ink that has leaked from said conduit;

at least one of a group of conductors including a power conductor and a control conductor formed on said substrate;

a first layer of conductive interface material that intercouples said one of said power and control conductors to said substrate; and wherein said mechanism that detects ink includes a detector formed on said substrate, said first layer and said detector are formed of the same conductive interface material, and wherein ink detection is achieved by monitoring for electrical interconnection between said detecting mechanism detector and said at least one power and control conductors.

2. The apparatus of claim 1, wherein said first layer and said detector are applied in the same fabrication step.

3. The apparatus of claim 1, wherein said conductive interface material is tantalum.

* * * * *